United States Patent [19]

Romberg

[11] Patent Number: 4,776,134

[45] Date of Patent: Oct. 11, 1988

[54] GATE CLOSURE WITH IMPROVED LATCH AND LATCHKEEPING MECHANISM FOR GATES THAT CLOSE THEMSELVES

[76] Inventor: Felix B. Romberg, P.O. Box 218, Holland, Tex. 76534

[21] Appl. No.: 35,366

[22] Filed: Apr. 7, 1987

Related U.S. Application Data

[63] Continuation-in-part of Ser. No. 825,480, Feb. 3, 1986, Pat. No. 4,662,111.

[51] Int. Cl.[4] ..... E05B 65/06; E05C 19/00

[52] U.S. Cl. ..... 49/394; 292/148; 292/175; 292/341.17; 292/DIG. 19

[58] Field of Search ..... 49/394; 292/341.17, 292/341.12, 137, 145, 148, 175, 163, 216, DIG. 19

[56] References Cited

U.S. PATENT DOCUMENTS

| | | | |
|---|---|---|---|
| 484,752 | 10/1892 | Hoffman | 292/341.17 X |
| 2,587,167 | 2/1952 | Kelley | 49/394 X |
| 2,869,913 | 1/1959 | Schlage | 292/341.12 |
| 3,206,240 | 9/1965 | Roethel | 292/341.12 X |
| 4,122,631 | 10/1978 | Batcheller | 49/394 |
| 4,495,730 | 1/1985 | Kennedy | 49/394 X |
| 4,512,105 | 4/1985 | Norton | 49/394 |

*Primary Examiner*—Philip C. Kannan
*Attorney, Agent, or Firm*—Daniel V. Thompson

[57] ABSTRACT

An improved latch and latchkeeping mechanism is provided for a gate closure for gates that close themselves. A detent mechanism is provided to allow the gate to be closed with the latch padlocked. Shock absorbing structure is also provided to absorb the shock of the closing gate.

4 Claims, 4 Drawing Sheets

20
26
30
24
82
22
22
9
9
94
86
90
22
5
62
42
59a
38
60
53
48
74
32
52
34
51
36
76
80
22
5
77
88
22
28
30

GATE CLOSURE WITH IMPROVED LATCH AND LATCHKEEPING MECHANISM FOR GATES THAT CLOSE THEMSELVES

CROSS REFERENCE

This application is a continuation-in-part of my application Ser. No. 825,480, filed Feb. 3, 1986, now U.S. Pat. No. 4,662,111.

TECHNICAL FIELD

This invention relates to gate latch mechancism, and more particularly to a gate latch and latchkeeping mechanism for a gate that closes itself after being opened against a closing force.

SUMMARY OF THE INVENTION

This invention, useful for example in combination with my prior invention titled "Mechanism for Controlled Closing of Hinged Gates" (U.S. patent application Ser. No. 825,480), is for a gate a vehicle driver leaves to close itself, after manually opening the gate against a closing force and driving through. The closing gate can become merely latched, or can be pre-set to close padlocked. The shock of the slamming gate is absorbed, and the gate end is held fixed to support the gate after closing.

BRIEF DESCRIPTION OF THE DRAWINGS

A more complete understanding of the invention and its advantages will be apparent from the Detailed Description taken in conjunction with the accompanying Drawings in which.

DETAILED DESCRIPTION

Figure 1:
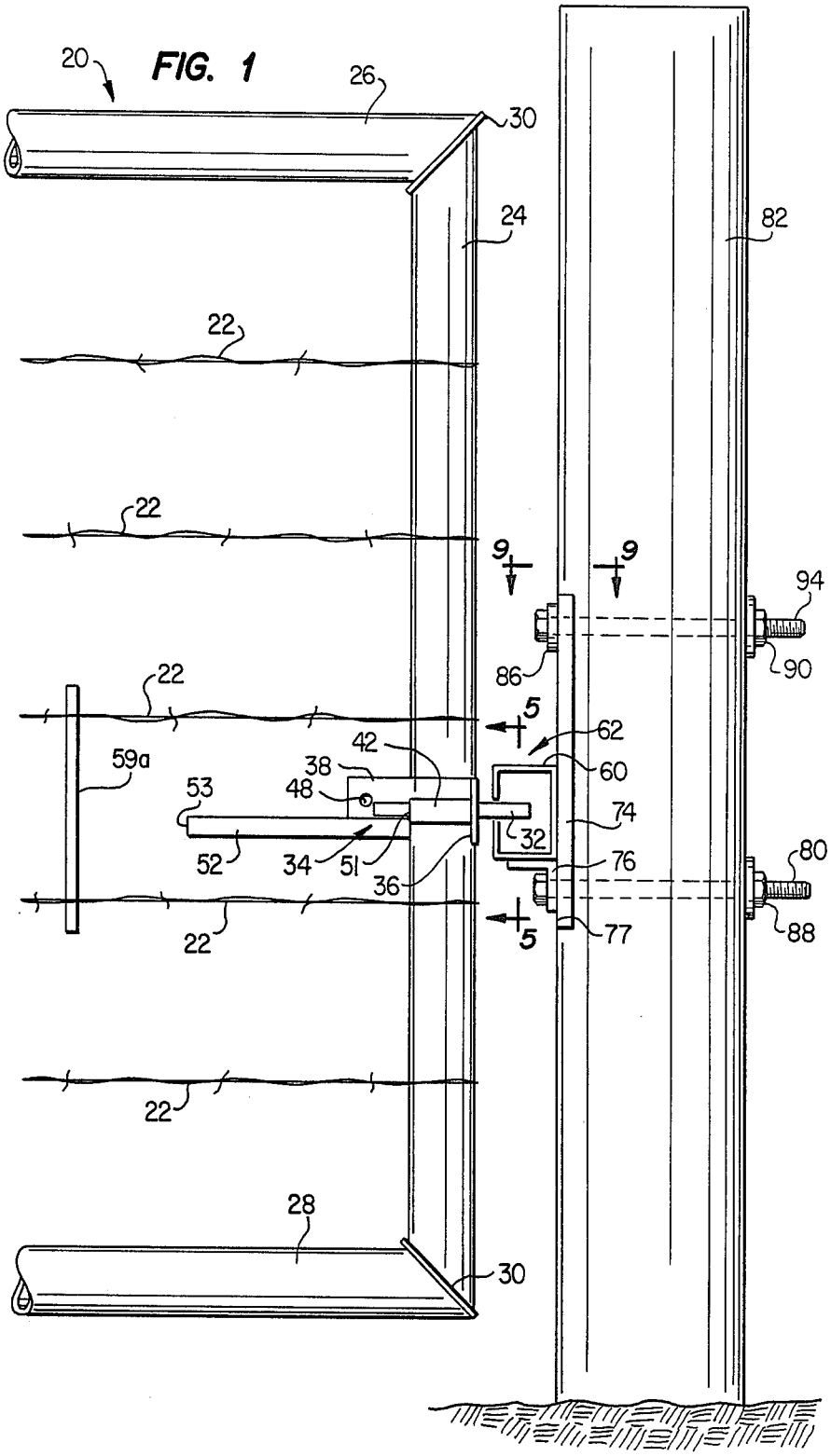
FIG. 1 is a partial elevation of that side of the gate to which the gate is openable.
Figure 9:
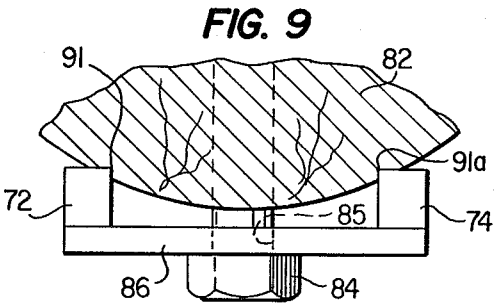
FIG. 9 is a partial detailed sectional view taken along lines 9—9 of FIG. 1.
Figure 2:
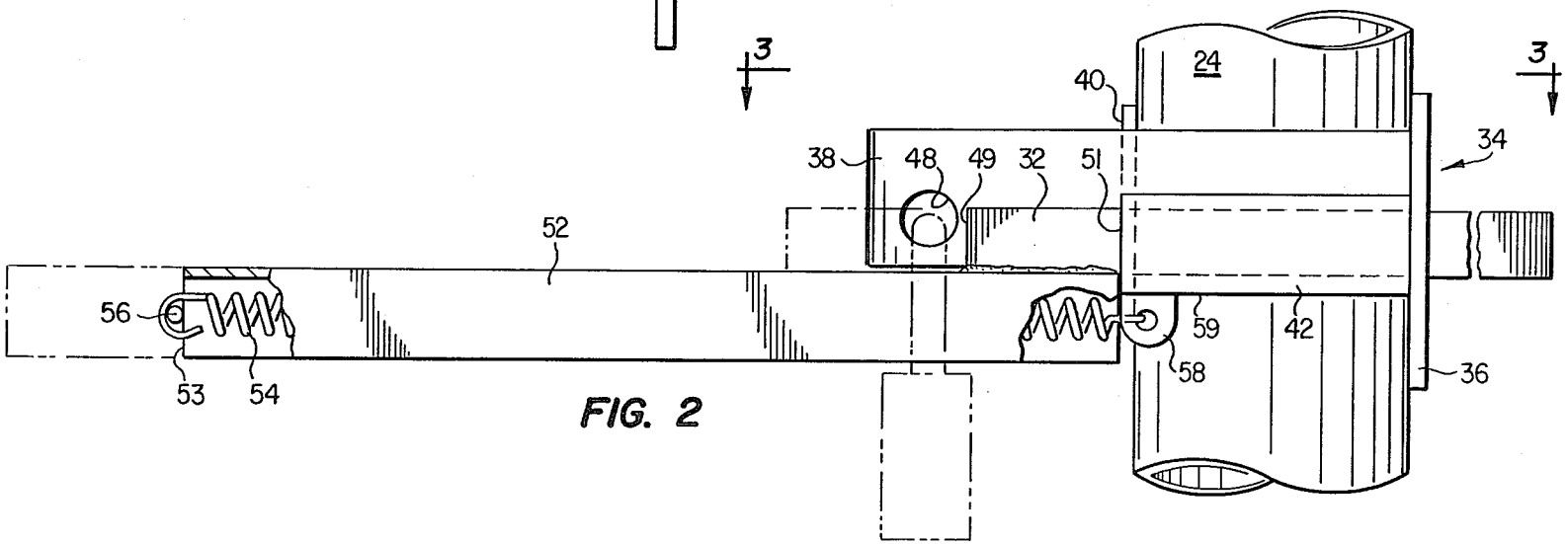
FIG. 2 is a partially broken away elevation view of the latch mechanism of the gate.
Figure 3:
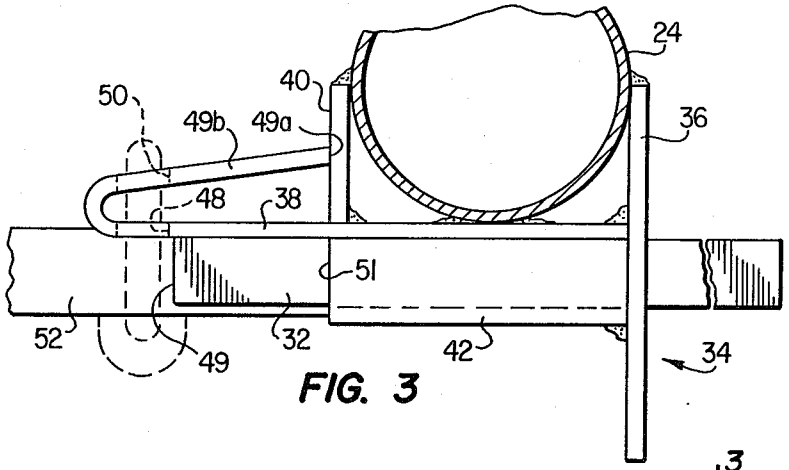
FIG. 3 is a partial sectional view taken along lines 3—3 of FIG. 2.
Figure 4:
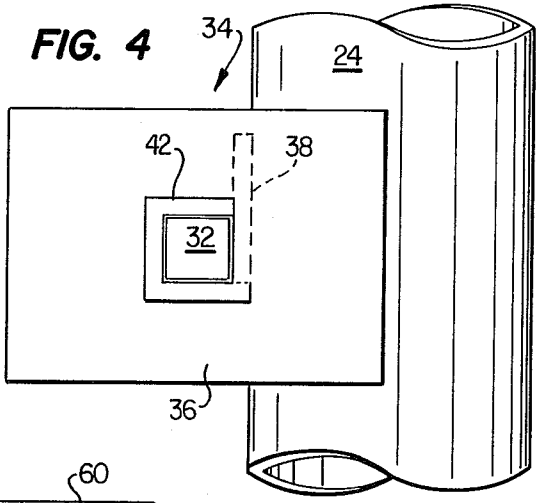
FIG. 4 is an end view of the latch mechanism.

Referring initially to FIG. 1, reference numberal 20 generally indicates the swingable end of a hinged gate having the light weight and low wind exposure required for self closing driveway gates. The gate includes a rectangular frame of large-diameter, thin-walled tubing and barbed wires 22. Upright 24 is connected to top frame member 26 and bottom frame member 28 by plates 30 sandwiched diagonally therebetween and welded to the adjacent frame members.

As shown in FIGS. 1–4, a rectangular latch bar 32 is mounted horizontally for longitudinally sliding movements on the side of upright 24 to which the gate is openable, the gate being openable in only one direction. The mechanism for supporting the latch bar may first be welded together into a unit 34, and then welded to upright 24. Unit 34 includes flat plate 36 which has one end welded tangentially against upright 24 as shown, flat piece 38 welded perpendicularly to flat piece 38 and tangentially to upright 24, three sided latch bar guide 42 welded at one end to plate 36 and along its open side welded to flat piece 38, and extending to opposite plate 40. Flat piece 38 extends beyond where latch bar 32 ends when it is in its extended position away from the gate shown in FIGS. 1–4. Flat piece 38 has perforation 48 behind end 49 of latch bar 32, and beyond perforation 48 flat piece 38 is doubled back to an end 49*a* welded to plate 40, with part 49*b* having perforation 50 registering with perforation 48. When the shank of a padlock is passed through perforations 48 and 50 it will pass behind end 49 of latch bar 32 and thus retain the latch bar in its extended position shown in FIGS. 1–4.

Beyond end 51 of guide 42, latch bar 32 is joined integrally with handle 52, which is hollow and open at the bottom and houses tension spring 54 extending from cross bar 56 at outer end 53 of handle 52 to perforated lug 58 secured to bottom 59 of guide 42. Spring 54 biases latch bar 32 towards its extended position. Latch bar 32 may be pulled back against the force of spring 54 to the position shown in phantom lines in FIG. 2 to unlatch the gate when no padlock is attached through perforations 48 and 50. Bar 59*a* is secured to adjacent barbed wires 22 above and below handle 52 behind end 53 to prevent persons from pulling latch bar 32 too far back and overextending spring 54. Beyond guide 42, plate 36 serves to block vision and restrict accessibility of the latchkeeping mechanism.

Figure 5:
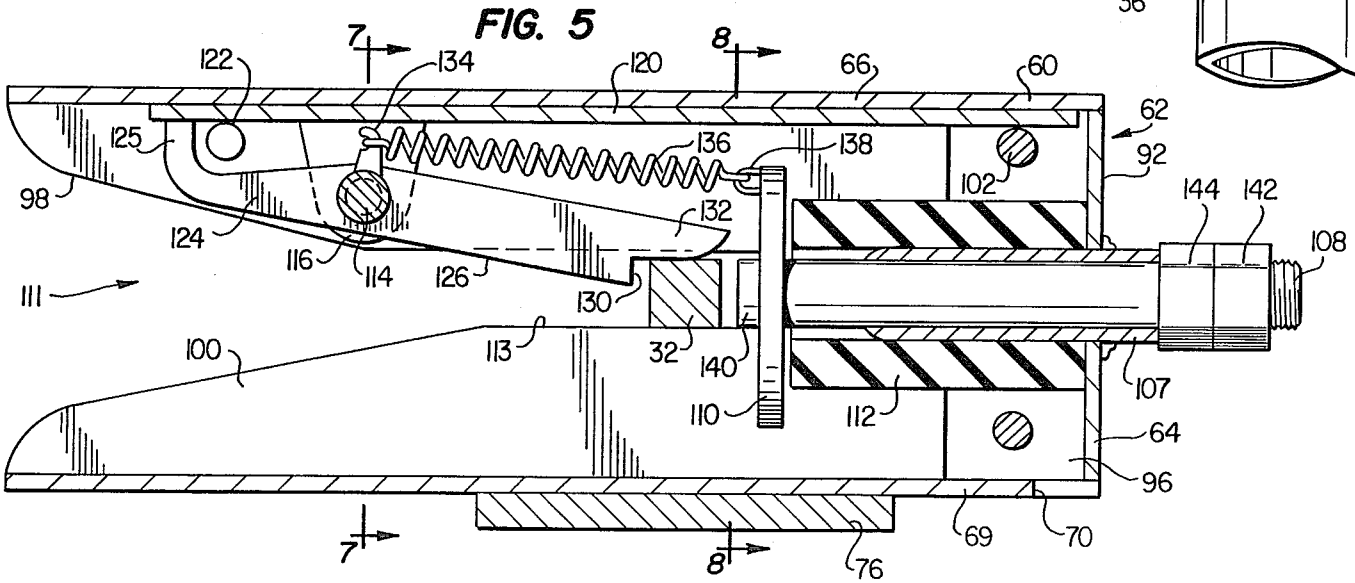
FIG. 5 is a detailed sectional view of the latch-keeping mechanism taken along lines 5—5 of FIG. 1.
Figure 6:
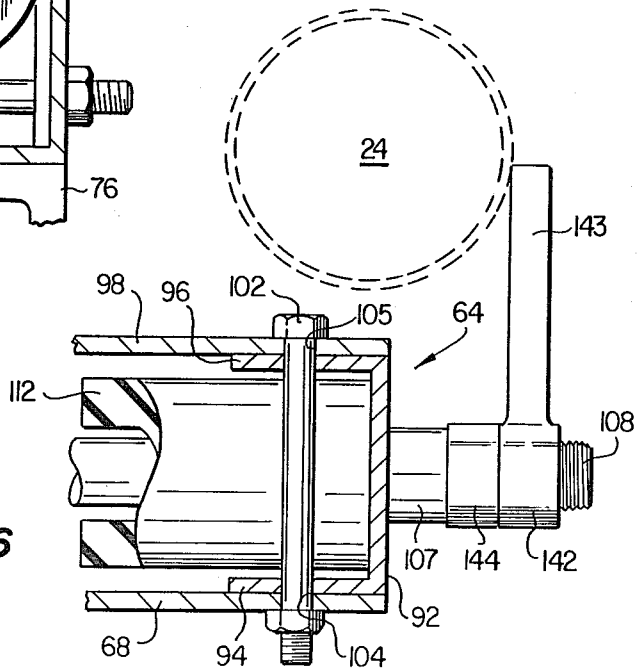
FIG. 6 is a partially broken away top view of the end piece of the housing of the latchkeeping mechanism.

Referring now to FIGS. 1 and 5–9, when the gate swings shut, extended latch bar 32 enters the open end and open side of housing 60 of latchkeeping mechanism 62. The other end of housing 60 is closed by end piece 64 (FIGS. 5 and 6). Housing 60 is boxlike with top wall 66, back wall 68 and bottom wall 69 each flat, straight and as long as housing 60, except that bottom wall 69 ends at opening 70 spaced from end piece 64 to allow water and dirt to drop from the interior of housing 60.

Back 68 of housing 60 is integrally secured to a pair of parallel upright bars 72 and 74 (FIGS. 1, 7 and 9), which bars are also integral with a short piece of angle iron 76 which is below and integral with the bottom of the boxlike housing 60. Lower flange 77 of angle iron 76 has a central perforation 78 through which bolt 80 anchors it to gate post 82. Another bolt 84 extends though central perforation 85 in cross piece 86 integrally connecting bars 72 and 74 at their upper ends. By tightening nuts 88 and 90 over washers, the inner corners 91 and 91a of bars 72 and 74, respectively, securely grip post 82 and hold the latchkeeping mechanism 62 fast to post 82.

Figure 8:
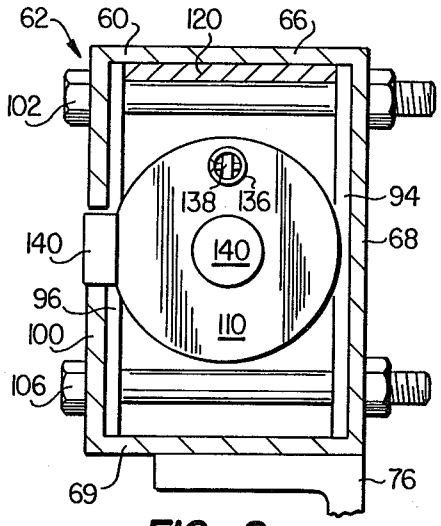
FIG. 7 and FIG. 8 are sectional views of the latchkeeping mechanism taken along lines 7—7 and 8—8 of FIG. 5.
Figure 7:
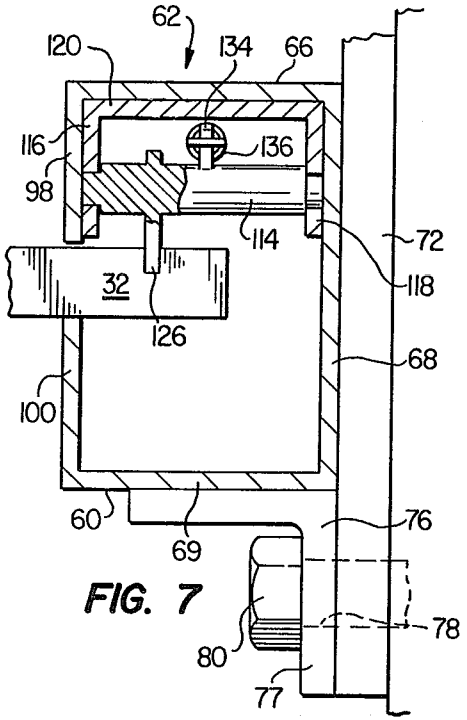

As seen in FIG. 6, end piece 64 includes end wall 92 and two thereto perpendicularly turned side walls 94 and 96 which fit snugly inside back wall 68 and upper and lower front wall portions 98 and 100 at the front side of the housing 60, as seen in FIG. 8. Bolt 102 passes through perforations 104 and 105 in the side walls 94 and 96 of end piece 64 through registering perforations in back wall 68 and upper front wall portion 98 of housing 60. Similarly. bolt 106 passes through perforations in side walls 94 and 96 at the lower portion of end piece 64 and registering perforations in back wall 68 and lower front wall portion 100. Thus the two bolts 102 and 106 fasten end piece 64 to the front and back walls of housing 60.

As seen in FIG. 5, end wall 92 is perforated in the center to contain therethrough a sleeve 107 welded to end wall 92 and extending perpendicularly therefrom in both directions. Bolt 108 is longitudinally slidable in said sleeve 107. At its inner end bolt 108 has an expanded head 110. A resilient elastomer bushing 112, or alternatively a coiled compression spring, surrounds sleeve 107 between bolt head 110 and end wall 92.

As shown in FIG. 5, the front wall of the housing includes a space 111 between upper front wall 98 and lower front wall 100 which receives and guides the extended latch bar 32. Space 111 has a wide entrance at the opn end of housing 60 and converges to a narrow slot 113 confining latch bar 32 vertically at its normal elevation.

Inside upper front wall portion 98 a shaft 114 is pivotally secured transversely to lugs 116 and 118 (FIGS. 5 and 7) extending down from and integral with plate 120 which rests longitudinally slidable on a crossbar 122 and the bolt 102, in vertical confinement under the top 66 of the housing. Crossbar 122 extends through and is secured to the opposite sidewalls of the housing 60. First latchkeeper arm 124 is integral with shaft 114 from which it extends forward beyond shaft 122 and then upward at portion 125 to normally make contact with plate 120 and thereby limit the downward rotation of a second and also integral latchkeeper arm 126 of shaft 114. Latchkeeper arms 124 and 126 may be considered a single lever, the longer latchkeeper arm 126 normally extending downwardly into the swing path of extended latch bar 32 to serve as a latchkeeping detent. Latchkeeper arm 126 has shoulder 130 for engaging the side of latch bar 32 and an upper extension 132 for engaging the top of latch bar 32.

A short upright arm 134 extends from shaft 114. Tension spring 136 extended from arm 134 to loop 138 secured to the top of bolt head 110. Bolt 108 is prevented from rotating by head extension 140 occupying slot 113. Extension 140 projects ahead of the face of bolt head 110 for sole engagement with latch bar 32.

Gate 20 is installed to be opened against a closing force only in the inward direction relative to the property it protects, a public thoroughfare, if any, being on the outer side. To prevent the gate from being opened in the wrong direction a wing nut 142 extends from bolt 108 in FIGS. 5 and 6 and includes wing 143 in the swing path of upright 24 as seen in FIG. 6. Second nut 144 holds wing nut 142 in place.

In operation, when gate 20 is not padlocked by means of the shank of a padlock being drawn through perforations 48 and 50, a pedestrian can open the gate by pulling the handle 52 back, then pushing or pulling the gate inward against its closing force. If he fails to swing the gate shut after walking through, it will be closed by the gate's closing force. A vehicle driver would swing the gate all the way open whereupon the gate becomes latched in its open position and swings shut after a predetermined interval leaving him adequate time to reenter his vehicle and drive past the open gate.

To cause the gate to close padlocked, the shank of the padlock is drawn through perforations 48 and 50 and the padlock is locked, after the gate has been opened beyond the latchkeeping mechanism and before the gate is swung to its open position. The gate will then be closed padlocked when it swings shut as it will be necessary to remove the padlock before the latch bar can be withdrawn beyond the latchkeeper arm 126. Hence, if the gate is closed padlockeed when a person wants to pass through, and is to be left padlocked after he has passed through, he must remove the padlock and replace it after the gate has been opened far enough for him to walk through. If he is a pedestrian he needs not swing the gate all the way open. For persons on the inner side of the gate it is also possible to find a way to lift the latchkeeper arm 126 and thus open the gate while the padlock is in place. But for persons on the outer side of the gate, latchkeepr arm 126 is neither visible nor accessible.

To insure closing, the gate must be opened with sufficient closing force to overcome conditions. Strong winds generally slacken greatly between gusts, so that released gate may be held open by a wind gust, but closes as the wind slackens. On the other hand, a wind gust may be behind the closing movement of the gate, causing the gate to close with added momentum. The primary closing shock of the gate is absorbed by the resilient elastomer bushing 112 and to a lesser extent by spring 136 and by the inherent rsilience of the gate. These resilient members cause the latch bar to reverse its movement, but action of spring 136 on shaft 114 has already forced the latchkeeper arm 126 down behind latch bar 32 and spring 136 is available to absorb the impact of latch bar 32 against the shoulder 130 of latchkeeping arm 126.

I claim:

1. In a gate hingedly supported at one end for opening from a closed position and swinging back to a closed position and having an upright frame member at its openable end, a gate closure comprising:

a latch bar having an end and mounted on the upright frame member for horizontal longitudinal movements between retracted and extended position.

means for normally keeping said latch bar end extended;

a latchkeeping mechanism mounted opposite the upright frame member in the closed position of said gate and in the swing path of said end of said latch bar in said extended position;

said latchkeeping mechanism including an elongated housing having a plurality of sides, first and second ends, and walls defining an opening at said first end and along one of said sides for receiving said end of said latch bar in the closing swing of the gate when said end is in said extended position, said opening converging from said first end of the housing to a longitudinal slot vertically confining said latch bar;

said second end of said elongated housing enclosing shock absorbing means engagable by said latch bar end in said extended position for arresting the closing swing of the gate by resiliently absorbing its momentum;

a latchkeeper pivotally secured within said housing above said opening and normally extending downwardly into the swing path of said latch bar end; and means for limiting the downward movement of said latchkeeper.

2. The gate closure according to claim 1, in which said shock absorbing means comprises:

an end wall closing said second end of said housing and having an inner surface;

a sleeve integral with said end wall and extending inwardly from said inner surface to an inner end;

a compressible, resilient member surrounding said sleeve and extending beyond the inner end of said sleeve;

a member longitudinally slidable in said sleeve and extending beyond the inner end of said sleeve;

a head on said slidable member extending over said resilient member and extending into said slot; and removable means on said slidable member outside said end wall for limiting the inward movement of said member.

3. The gate closure according to claim 2 wherein said latchkeeping mechanism further comprises:

a frame mounted in the upper part of said housing for limited sliding movements longitudinally in said housing;

said frame pivotally carrying a shat crosswise within said housing;

said latchkeeper being a first arm fixed for rotation with said shaft and normally extending downwardly from said shaft;

means to limit rotation of said shaft;

a second arm fixed for rotation with said shaft and extending upwards from said shaft; and a tension spring strung from said second arm to said head of said slidable member of said shock absorbing means.

4. The gate closure according to claim 1 further comprising:

a frame affixed to one side of the upright frame member for supporting said latch bar adjacent to and on that side of said upright frame member;

said affixed frame having a front end facting the latchkeeping mechanism when the gate is in its closed position and having an opposite rear end;

said latch bar having a rear end secured to an offset handle, and said rear end of said affixed frame includes an extension beyond the normal position of the rear end of said latch bar, where said extension is perforated to receive the shank of padlock extending behind the end of said latch bar to keep said latch bar in its extended position.

* * * * *

UNITED STATES PATENT AND TRADEMARK OFFICE

CERTIFICATE OF CORRECTION

PATENT NO. : 4,776,134

DATED : October 11, 1988

INVENTOR(S) : Felix B. Romberg

It is certified that error appears in the above-identified patent and that said Letters Patent is hereby corrected as shown below:

Col. 2, line 1, insert --plate 36 and tangentially to upright 24, plate 40 welded perpendicularly to-- after "to".

Col. 5, line 11, change "shat" to --shaft--.

Signed and Sealed this

Fourth Day of April, 1989

*Attest:*

*Attesting Officer*

DONALD J. QUIGG

*Commissioner of Patents and Trademarks*